US009863648B2

(12) United States Patent
Weinraub

(10) Patent No.: US 9,863,648 B2
(45) Date of Patent: Jan. 9, 2018

(54) EQUIPMENT PROTECTOR WITH BUOYANT RIM

(71) Applicant: Benjamin J. Weinraub, Philadelphia, PA (US)

(72) Inventor: Benjamin J. Weinraub, Philadelphia, PA (US)

( * ) Notice: Subject to any disclaimer, the term of this patent is extended or adjusted under 35 U.S.C. 154(b) by 182 days.

(21) Appl. No.: 14/769,641

(22) PCT Filed: Feb. 19, 2014

(86) PCT No.: PCT/US2014/017040

§ 371 (c)(1),
(2) Date: Aug. 21, 2015

(87) PCT Pub. No.: WO2014/130504

PCT Pub. Date: Aug. 28, 2014

(65) Prior Publication Data

US 2016/0018114 A1 Jan. 21, 2016

Related U.S. Application Data

(60) Provisional application No. 61/850,659, filed on Feb. 21, 2013.

(51) Int. Cl.
*B63C 9/15* (2006.01)
*F24D 19/10* (2006.01)
(Continued)

(52) U.S. Cl.
CPC ..... *F24D 19/1051* (2013.01); *B63C 9/15* (2013.01); *F24H 9/165* (2013.01); *E02B 3/104* (2013.01)

(58) Field of Classification Search
CPC .... B63C 9/00; B63C 9/08; B63C 9/15; B63C 9/20; D06F 39/00; F24C 3/12; F24H 9/02
(Continued)

(56) References Cited

U.S. PATENT DOCUMENTS 3,048,860 A * 8/1962 Richardson ..... B63C 9/155 441/123
4,261,070 A 4/1981 Shimokawa
(Continued)

FOREIGN PATENT DOCUMENTS

WO 2007/030058 A1 3/2007
WO 2009/109735 A1 9/2009

OTHER PUBLICATIONS

CHR® Pressure-Sensitive Adhesive Tapes Data Sheet, Saint Gobain Performance Plastics 2009 (2 pages); retrieved from www.foams.saint-gobain.corn/uploadedFiles/SGfoams/documents/stripnstick.pdf.

(Continued)

*Primary Examiner* — Lars A Olson
(74) *Attorney, Agent, or Firm* — Fox Rothschild LLP

(57) ABSTRACT

An equipment protector including a tubular body extending from a first end to a second. The tubular body is manufactured from a waterproof, collapsible material and has a first diameter. A buoyancy ring is sealingly connected to the first end of the tubular body and defines a through passage. The buoyancy ring has an outer diameter which is larger than the first diameter such that the buoyancy ring extends radially outwardly from the tubular body and is susceptible to a buoyancy force created at the exterior of the tubular body. A method of protecting equipment is also provided.

20 Claims, 6 Drawing Sheets

(51) Int. Cl.
*F24H 9/16* (2006.01)
*E02B 3/10* (2006.01)

(58) Field of Classification Search
USPC ..... 441/123, 131; 150/144, 146, 165
See application file for complete search history.

(56) References Cited

U.S. PATENT DOCUMENTS

| | | | |
|---|---|---|---|
| 5,190,089 | A | 3/1993 | Jackson |
| 6,659,825 | B2 | 12/2003 | Foss |
| 2008/0017135 | A1 | 1/2008 | Broadway et al. |

OTHER PUBLICATIONS

International Search Report dated Jun. 10, 2014 issued in International Patent Application No. PCT/US2014/017040 (15 pages).

* cited by examiner

EQUIPMENT PROTECTOR WITH BUOYANT RIM

This application is a national phase application of PCT International Patent Application No. PCT/US14/17040, filed on Feb. 19, 2014, which claims the benefit of U.S. Provisional Application No. 61/850,659, filed on Feb. 21, 2013, the contents of each of which are incorporated herein by reference.

FIELD OF THE INVENTION

This invention relates to the detection and prevention of damage to home and business equipment, although not limited to home and businesses, from accidental water infiltration from natural and manmade disasters, primarily but not limited to floods, pipe breaks, system backup, system leaks, as well as to protect the home and businesses from damage from water in the event of leaks of the equipment itself.

BACKGROUND OF THE INVENTION

Water infiltration into homes, high rise condominiums or apartments, and businesses, and even extending to systems in sea craft and cruise liners can amount to serious damage thus causing huge amounts of monetary expense effecting as once this equipment gets wet, particularly in the case of salt water and gas fired equipment, there is no option to repair only replace.

FEMA suggest many ideas to mitigate this risk, including raising equipment to higher floors, hanging equipment off of rafters to raise them up above flood plains, and building an interior floodwall as detailed on their website. The first two instances are options if willing to relocate or installing new equipment but involve significant cost in relocating the piping associated with the equipment. The third, building a flood wall, is also costly and makes many assumptions including that there is a watertight floor, and foundation walls, or significant effort has to be expended to get them to that condition. Moreover, there needs to be a balance between building walls high enough for a recommend 100 year flood, and being able to get over them to service and maintain the equipment or add more cost with waterproof gates or steps.

The source of water can also emanate from the equipment itself, mainly but not limited to hot water heaters, boilers, freezers washing machines, ice makers . . . , and can pose a threat to the homes and business from within. The most common water-leak problem comes from hot water-tank systems, which if left to leak water can and usually does cause serious damage to the basement belongings.

A high rise building such as condos or apartments, serious water-leak damage is most pronounced and more severe than in most homes.

SUMMARY OF THE INVENTION

In at least one aspect, at least one embodiment of the present invention provides an equipment protector including a tubular body extending from a first end to a second. The tubular body is manufactured from a waterproof, collapsible material and has a first diameter. A buoyancy ring is sealingly connected to the first end of the tubular body and defines a through passage. The buoyancy ring has an outer diameter which is larger than the first diameter such that the buoyancy ring extends radially outwardly from the tubular body and is susceptible to a buoyancy force created at the exterior of the tubular body and an inner diameter smaller than the first diameter such that the buoyancy ring extends radially inwardly from the tubular body and is susceptible to a buoyancy force created at the interior of the tubular body.

In another aspect, at least one embodiment of the present invention provides an equipment protector including a tubular body extending from a first end to a second. The tubular body is manufactured from a waterproof, collapsible material. A buoyancy ring, defined by an inflatable ring, is sealingly connected to the first end of the tubular body. The tubular body includes a sealable seam extending from the first end to the second end and the inflatable ring has closed ends which are aligned with the sealable seam.

In yet another aspect, at least one embodiment of the present invention provides a method of protecting a piece of equipment positioned with a bottom end thereof on a support surface. The method includes the steps of positioning an equipment protector, including a tubular body manufactured from waterproof material and extending from a first end to a second end with a buoyancy ring sealingly connected to the first end, about the piece of equipment such that the tubular body second end defines a sealed connection relative to the support surface such that the piece of equipment is within a sealed interior chamber within the tubular member and the piece equipment passes through a through passage of the buoyancy ring such that the buoyancy ring may move along the piece of equipment.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
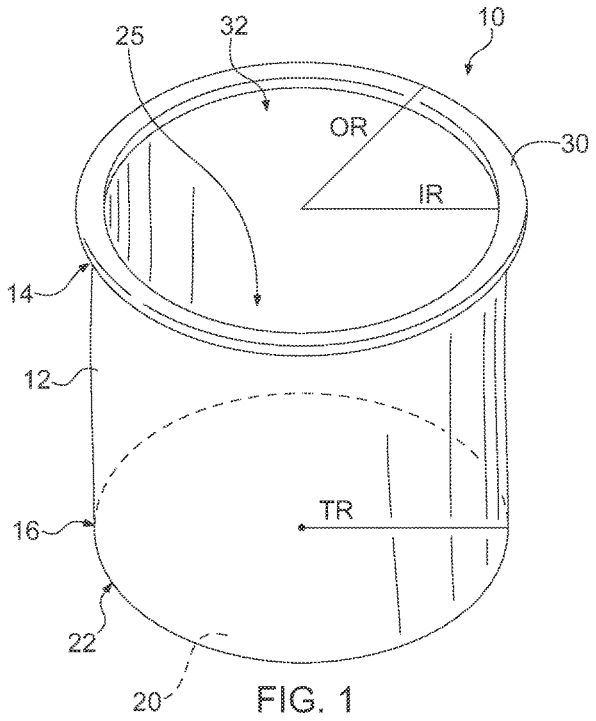
FIG. 1 is a perspective view of an exemplary equipment protector in accordance with an embodiment of the invention in an extended position.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
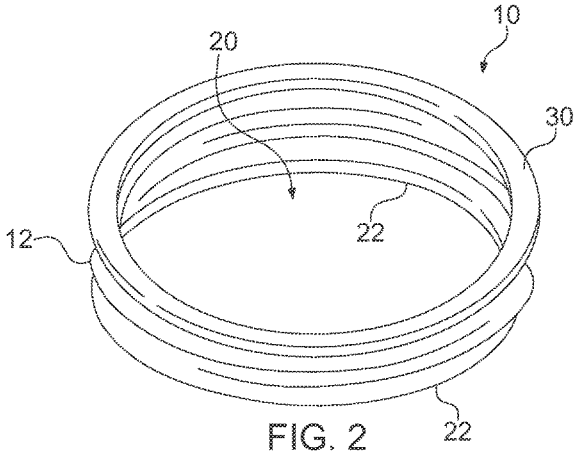
FIG. 2 is a perspective view of the equipment protector of FIG. 1 in a collapsed position.
Figure 3:
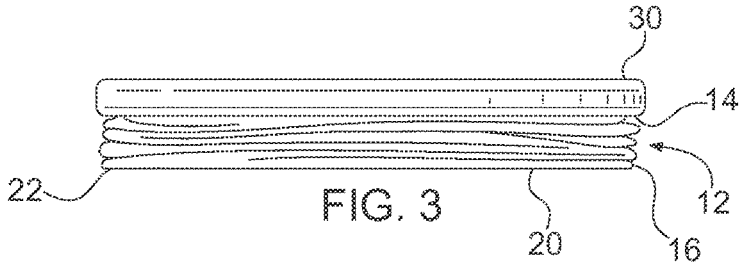
FIG. 3 is a side elevation view of the equipment protector of FIG. 1 in a collapsed position.

Referring to FIGS. 1-3, an exemplary equipment protector 10 in accordance with an embodiment of the invention will be described. The equipment protector 10 includes a tubular body 12 having a top end 14 and a bottom end 16. The tubular body 12 is manufactured from a collapsible, waterproof material. An exemplary material is a durable nylon fabric with a polyurethane coating. The fabric may be provided with extra resistance to tearing or the like and may be for example, Minopex Rip Stop 12 Fabric. Other waterproof fabrics and materials may be utilized. While the term waterproof is utilized, it is understood that waterproof means resistant to passage of water, but may also be resistant to passage of other liquids.

A bottom member 20 extends across the bottom end 16 and is sealed to the tubular body 12 at the sealed edge 22. The bottom member 20 is also manufactured from a waterproof material which may be the same or different than the material of the tubular body 12. With the sealed edge, the tubular body 12 and the bottom member 20 define a waterproof interior chamber 25. In the present embodiment, liquids are prevented from entering into the interior chamber 25 through the bottom end 16 of the tubular body 12 or through the body 12 or bottom member 20 themselves.

A buoyancy ring 30 with a through passage 32 is attached to the top end 14 of the tubular body 12 in a sealed manner. The through passage 32 opens into the interior chamber 25 such that a piece of equipment to be protected can be positioned within the interior chamber 25 and extend through the through passage 32. The buoyancy ring 30 has a density less than the density of water, or other liquids which the protector 10 may be exposed to, such that the buoyancy ring 30 will float on the water or other liquid. In the current embodiment, the buoyancy ring 30 is a solid structure, for example, manufactured from expandable foam, which may be covered or uncovered. The buoyancy ring 30 preferably has an outer radius OR which is larger than the radius TR of the tubular body 12 and an inner radius IR, defined by the through passage 32, which is smaller than the radius of the tubular body 12. In this way, the buoyancy ring 30 extends radially outward and radially inward of the tubular body 12 and is thereby susceptible to a buoyancy force created along the exterior surface or interior surface of the tubular body. That is, a significant amount of external liquid or internal liquid will contact the buoyancy ring 30 and cause it to float. Internal liquid may occur if the protected piece of equipment, for example a water heater or clothes washer, develops a leak, whereby the tubular body 12 will be extended by the rise of internal liquid and the liquid will be contained and not damage other equipment or building materials around the leaking piece of equipment.

Due to the collapsible nature of the tubular body 12, when the buoyancy ring 30 is not exposed to an amount of liquid to cause it to float, the equipment protector 10 has the default collapsed position illustrated in FIGS. 2 and 3, i.e. with the buoyancy ring 30 proximate the bottom member 20 with the tubular body 12 collapsed therebetween. As will be described in more detail hereinafter, in the event of flooding, leak or the like proximate the piece of equipment to be protected, the buoyancy ring 30 will float on the water and thereby extend to the extent necessary the collapsed tubular body 12. FIG. 1 shows the tubular body 12 in a fully extended position. The height of the tubular body 12 in the fully extended position may be selected based on the height of the equipment to be protected, location of particular elements on the equipment, or the anticipated potential flood height, amongst other considerations.

Figure 4:
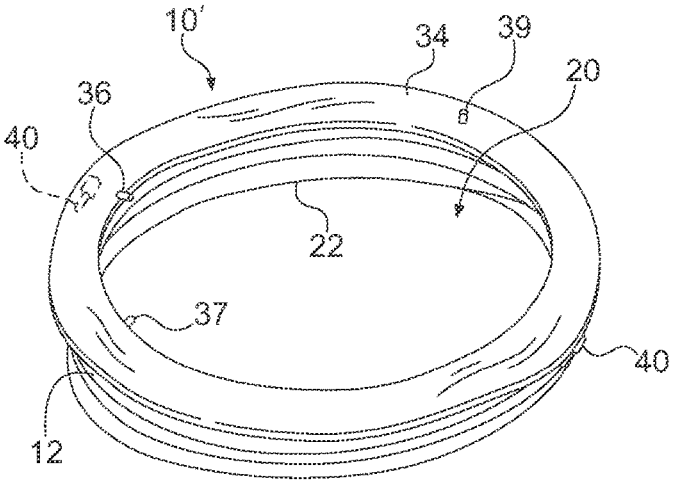
FIG. 4 is a perspective view of another exemplary equipment protector in accordance with an embodiment of the invention in a collapsed position.
Figure 5:
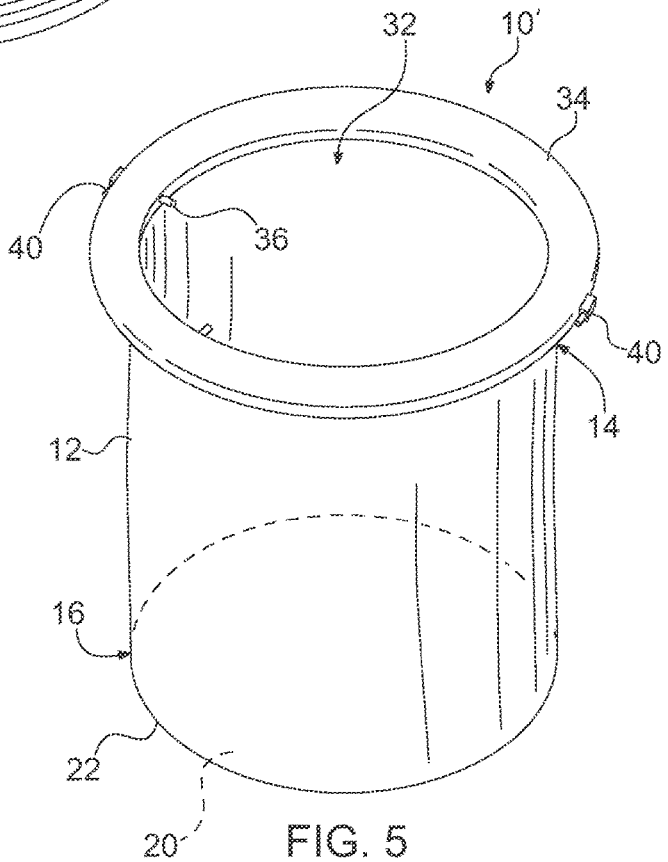
FIG. 5 is a perspective view of the equipment protector of FIG. 4 in an expanded position.
Figure 6:
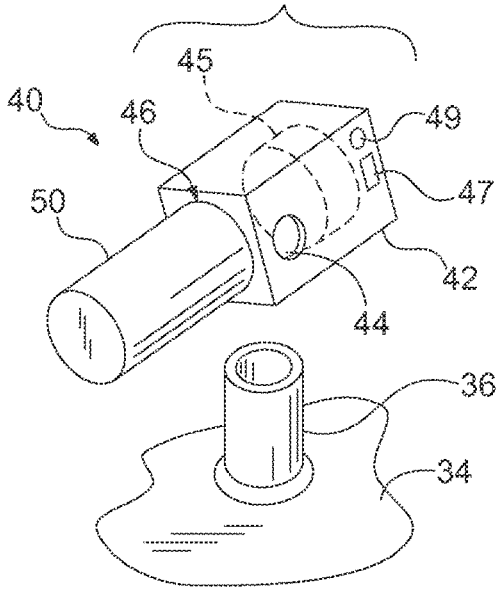
FIG. 6 is a perspective view of an exemplary inflation assembly utilized with the equipment protector of FIG. 4.

Referring to FIGS. 4-6, an exemplary equipment protector 10' in accordance with an alternative embodiment of the invention will be described. The equipment protector 10' is substantially the same as in the previous embodiment, except that the buoyancy ring 30' is defined by an inflatable ring 34. In a preferred embodiment, the inflatable ring 34 is manufactured from the same material as the tubular body 12. As illustrated in FIG. 4, in the collapsed position, the inflatable ring 34 is deflated such that the equipment protector 10' has a lower profile compared to the previous embodiment.

To inflate the inflation ring 34, the ring 34 includes one or more nipples 36 configured to receive automated inflation air from an inflation assembly 40. Alternatively or additionally, the inflation ring 34 may include one or more manual inflation nipples 37 which allow the user to manually inflate the inflation ring 34 or manually maintain pressure within the ring 34. An openable outlet 39 may be provided to allow deflation of the inflation ring 34 once the inflation is no longer necessary.

FIG. 6 illustrates an exemplary inflation assembly 40. Each inflation assembly 40 includes a body 42 with an opening 44 configured to receive an inflation nipple 36. The nipples 36 are received in the openings 44 such that the body 42 is retained on the nipple 36 and fluid may be passed through the body 42 into the nipple 36, as is known in the art. The body 42 also includes an opening 46 configured to receive the neck of a compressed CO2, air or other gas cartridge 50. A valve and hydro sensor are also positioned within the body 42 to prevent flow from the cartridge 50 to the nipple 36 until water or other liquid is sensed. In the illustrated embodiment, the valve and hydro sensor are incorporated into a single auto-inflation bobbin 45. The bobbin 45 includes a rigid body with a plurality of through passages which are blocked by a liquid dissolvable material. Once the bobbin 45 gets wet, the dissolvable material dissolves such that the through passages are opened and the compressed gas passes from the cartridge 50 through the nipple 36 and into the inflation ring 34. While a dissolvable bobbin 45 is described, other valve and sensor configurations may be utilized. For example, an electromechanical valve may be utilized with an electronic hydro sensor. In the illustrated embodiment, nipples 36 are provided on opposite sides of the ring 34 on both the inside and outside thereof. Such a configuration allows the user to connect inflation assemblies inside and outside and on opposites of the ring 34 to insure inflation of the ring 34 whether the water is from an external source or an internal source. If a user is not concerned with internal leaking, they can leave the internal nipples 36 free, as illustrated.

The illustrated inflation assembly 40 also includes an indicator light 49 configured to provide the user with an easy to discern indication whether the inflation assembly 40 is in proper operating condition. For example, a green light may indicate that the cartridge 50 and bobbin 45 are in proper operating condition, while a red light may indicate a problem which needs to be addressed, for example, the cartridge 50 may need to be replaced. The indicator light 49 may be connected with one or more sensors (not shown) and a controller (not shown) to facilitate such functionality, as is known in the art.

The inflation assembly 40 may also include a further sensor/transmitter 47 configured to send signals upon sensing of water or activation of the inflation assembly 40. In one embodiment, the sensor/transmitter 47 can send a control signal to one or more electro-mechanical shut-off valves associated with the equipment. Such could be used, for example, to stop the flow of water to or from the equipment or to stop the flow of gas or the like to the equipment during a flood situation. In another aspect, the sensor/transmitter 47 may be configured to sound an audible alarm alert and/or be in communication with an external means for calling, emailing, texting, or otherwise alerting a homeowner, security system or company, or local utility or emergency response department of a water infiltration or leak in process. The sensor/transmitter 47 does not have to be housed within the inflation assembly 40 and may be otherwise positioned on the inflation ring 34. Additionally, such a sensor/transmitter 47 may also be positioned on the solid buoyancy ring 30 of the first embodiment.

Figure 7:
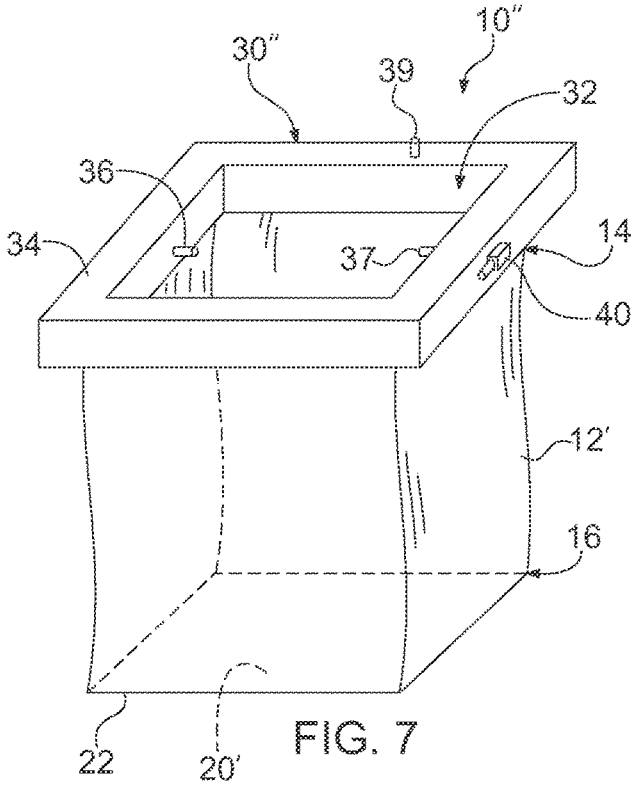
FIG. 7 is a perspective view of another exemplary equipment protector in accordance with an embodiment of the invention in an extended position.
Figure 8:
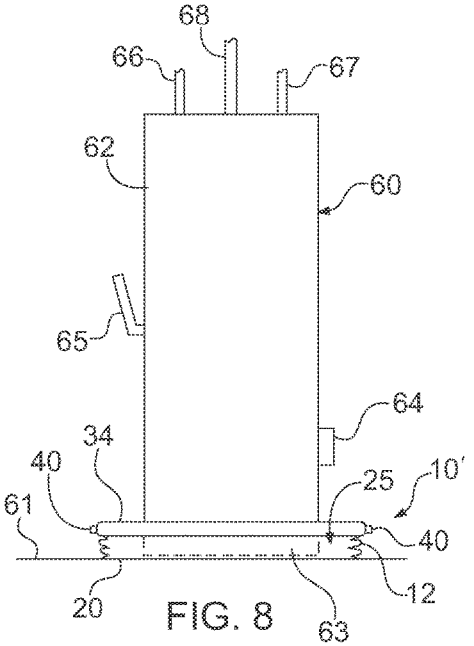
FIGS. 8-11 are schematic elevation views illustrating exemplary operation of the equipment protector of FIG. 4.

Referring to FIG. 7, an exemplary equipment protector 10" in accordance with another embodiment of the invention is shown. The equipment protector 10" is the same as the equipment protector 10' except that the tubular body 12', the bottom member 20' and the buoyancy ring 30" have a square configuration instead of the round configuration of the equipment protector 10'. The equipment protectors 10, 10', 10" may have any desired shape and are preferably selected to have a shape which corresponds to the equipment to be protected. For example, the round configuration of the protector 10, 10' may be selected for use with a hot water heater while the square configuration of the protector 10" may be selected for use with a clothes washer or dryer or a furnace. The invention is not limited to any particular shapes and the protectors may have any desired shape.

Referring to FIGS. 8-11, use of the protectors 10, 10', 10" with a newly installed piece of equipment 60 will be described. In the illustrated use, the piece of equipment 60 is a water heater with a cylindrical housing 62 with a bottom end 63. The heater may include a control box 64, a gas supply line 65, a water supply line 66, a water return line 67 and a vent 68. The equipment protector 10' is positioned with its bottom member 20 on the floor 61 or other support surface and the bottom end 63 of the housing 62 is positioned within the interior chamber 25. The supply and exit lines 65-68 are preferably connected after positioning relative to the equipment protector 10'. Once installed, the equipment protector 10' remains in the collapsed position illustrated in FIG. 8 until liquid is detected.

Figure 9:
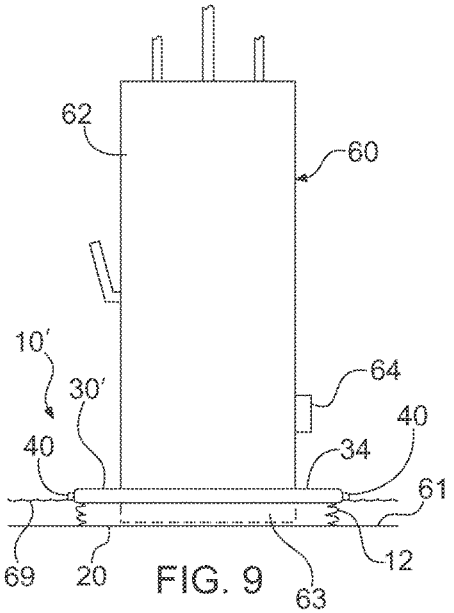
Figure 10:
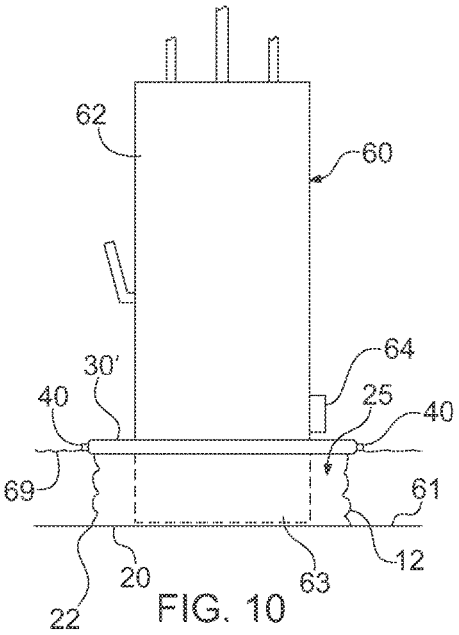
Figure 11:
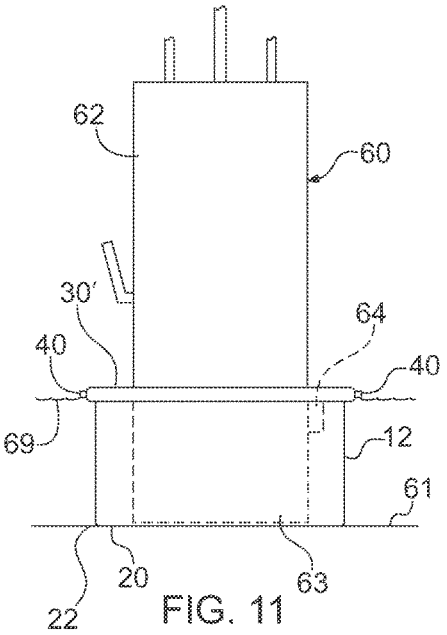
Figure 12:
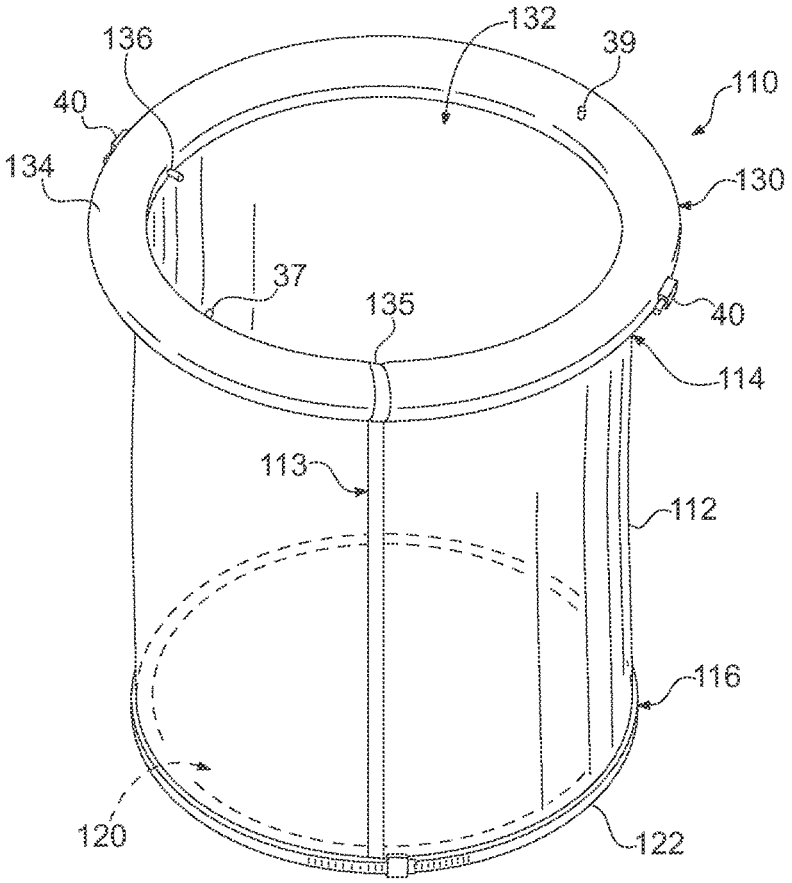
FIG. 12 is a perspective view of yet another exemplary equipment protector in accordance with an embodiment of the invention in an extended position.
Figure 13:
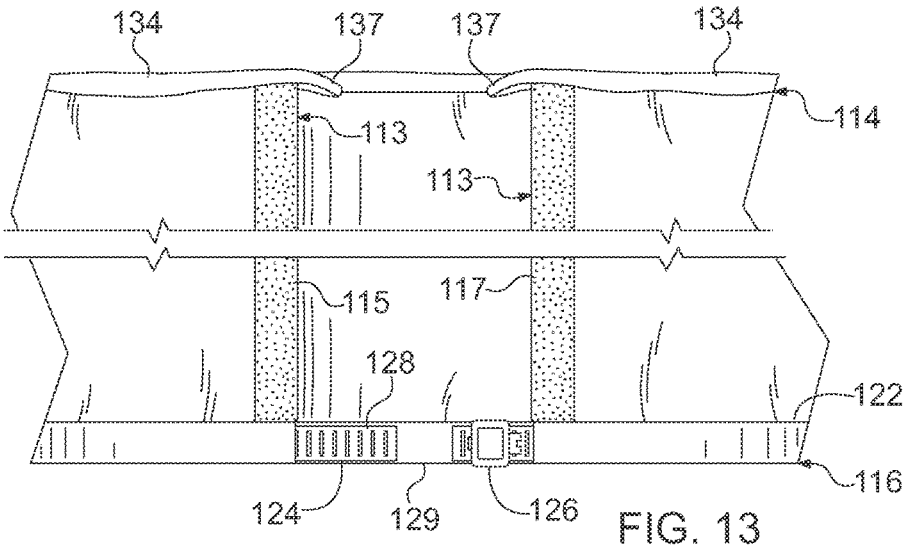
FIG. 13 is an elevation view of the equipment protector of FIG. 12 in an unsealed configuration.
Figure 14:
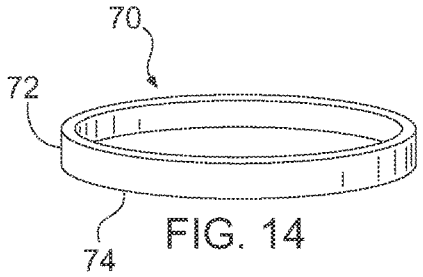
FIG. 14 is a perspective view of an exemplary drip pan that may be utilized with the equipment protector of FIG. 12.
Figure 15:
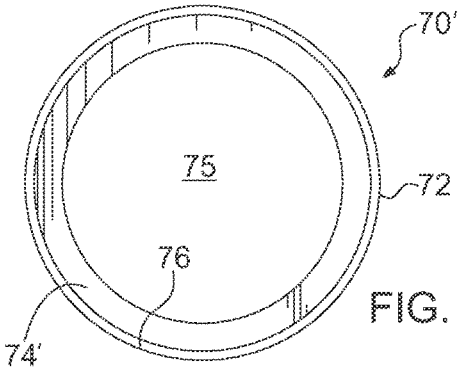
FIG. 15 is a top plan view of exemplary modified drip pan that may be utilized with the equipment protector of FIG. 12.

Referring to FIG. 9, once the fluid level 67 reaches the inflation assemblies 40, the inflation ring 34 is inflated such that the buoyancy ring 30' begins to float on the fluid. As the fluid level 67 rises, the buoyancy ring 30' rises and begins to extend the tubular body 12, as shown in FIG. 10. The sealed edge 22 between the tubular body 12 and the bottom member 20 maintains the interior chamber 25, and thereby the heater 60, dry. As the water level 67 rises further, the buoyancy ring 30 will cause the tubular body 12 to extend to the fully extended position as illustrated in FIG. 11. In the illustrated embodiment, the fully extended position extends beyond at least the control box 64 of the heater. If desired, the height could be selected to extend to the top of the heater 60 or even to the height of the ceiling where the heater is positioned. The inflation ring 34 will remain inflated and the protector 10' extended, in theory, indefinitely, but in any event for a substantial time, preferably sufficiently long enough for the owner or service professional to pump the flood water away from the equipment or for the water to recede. The alarm system described above will aid in providing prompt pumping of the flood water. After the water has been pumped out or has receded, the inflation ring 34 can be deflated and the protector 10' reset to the default position where it is ready to protect again. The inflation assemblies 40 may require replacement during the resetting procedure.

As seen in the description with respect to FIGS. 8-11, supply lines and the like may make it difficult to position the bottom member 20 under the equipment without substantial disassembly of the equipment. The equipment protector 110 illustrated and described with respect to FIGS. 12-17 facilitates positioning of the protector 110 around the equipment without the requirement to position any of the protector 110 under the equipment. The equipment protector 110 includes a collapsible tubular body 112 extending from a top end 114 to a bottom end 116. The tubular body 112 includes a sealable longitudinally extending seam 113 and an opening 120 at the bottom end 116. The inflation ring 134 which defines the buoyancy ring 130 includes free ends 137 aligned with the seam 113. With this configuration, the protector 110 may be wrapped around the equipment 60 without the need to position any of the protector 110 under the equipment 60. Once the protector 110 is positioned around the equipment, the seam 113 is closed by a waterproof seal. In the present embodiment, the waterproof sealer includes opposed silicone tape members 115, 117, with one tape member 115 on the outside of the tubular body 112 and the other tape member 117 on the inside of the tubular body 112. The silicone tape members 115, 117 are configured to chemically fuse when brought into contact with one another to form the waterproof seal. The waterproof seal may take any other desired configurations, for example, a waterproof zipper or ziplock. A piece of waterproof tape 135 or the like may be utilized to cover and join the free ends 137 of the inflation ring 134.

Figure 16:
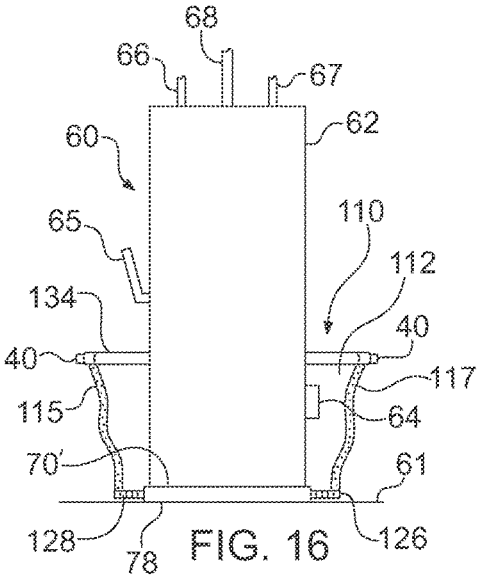
FIGS. 16 and 17 are schematic elevation views illustrating positioning of the equipment protector of FIG. 12 about a water heater.
Figure 17:
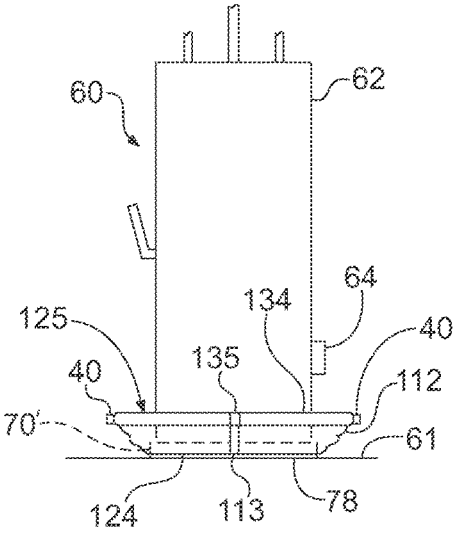

In addition to waterproofing the seam 113, it is also necessary to waterproof the bottom end 116 of the tubular body 112 such that water or the like does not enter through the opening 120. In the present embodiment, a connector ring 124 extends through a pocket 122 extending along the bottom end 116 of the tubular body 112. The connector ring 124 may take the form of an adjustable hose clamp with a slotted band 128 and a screw connector 126. The connector ring 134 is configured to connect to and seal about a drip pan 70 positioned under the equipment 60 similar to the one illustrated in FIG. 14. The drip pan 70 has a wall 72 extending from a bottom surface 74 and is generally waterproof. As such, connection of the connector ring 124 about the wall 72 will create a waterproof interior chamber 125. A piece of uneven surface tape 129 may be positioned between the connector ring 124 and the pan wall 72 to further insure the interior is waterproof In the event the equipment 60 is not positioned within a drip pan, a drip pan 70' similar to the one illustrated in FIG. 15 can be retro-fit about the bottom of the equipment 60. The drip pan 70' has a side wall 72 and a portion of the bottom surface 74' with a central opening 75. A slot 76 extends through the side wall 72 and the portion of the bottom surface 74' to the central opening 75 such that the pan 74' may be opened along the slot 76 and positioned around the bottom of the equipment. Once positioned, the pan 70' is sealingly secured to the support surface 61, for example, using a waterproof adhesive 78 as illustrated in FIGS. 16 and 17. The waterproof adhesive 78 may be, for example, self-stick rubberized roofing cover strip/repair tape, which as one example, is sold under the tradename EDPM Quick Roof. Fasteners (not shown) may be secured through the bottom surface 74' to further secure the pan 70'. Once the pan 70' is secured about the equipment 60, the connector ring 124 may be secured and the seam 113 sealed as shown in FIGS. 16 and 17 and described above.

Figure 18:
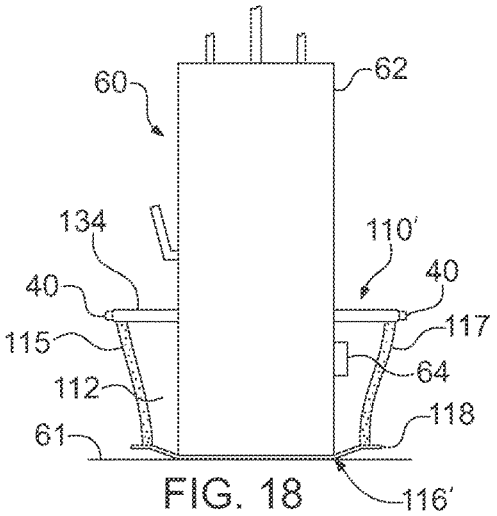
FIGS. 18 and 19 are schematic elevation views illustrating positioning of another exemplary equipment protector in accordance with an embodiment of the invention about a water heater.
Figure 19:
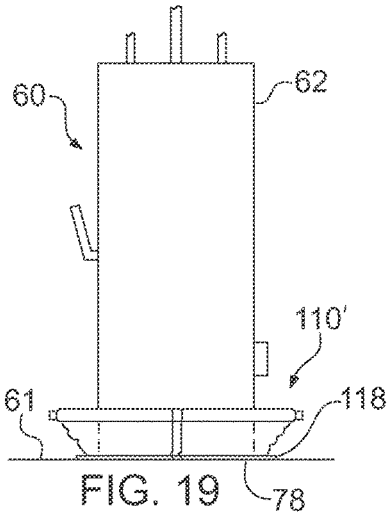

Referring to FIGS. 18 and 19, an exemplary equipment protector 110' similar to the previous embodiment will be described. The present embodiment is substantially the same, but in place of the connector ring, the protector 110' includes a radially extending flange 118, which is formed of the same material and integral with the tubular body 112. After the tubular body 112 is positioned about the equipment 60 and sealed at seam 113, the flange 118 is sealingly secured to the support surface 61 using a waterproof adhesive similar to that described above. With the flange 118 secured, the protector 110' again defines a waterproof interior chamber 125 about the equipment.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. An equipment protector comprising:

a tubular body extending from a first end to a second, the tubular body manufactured from a waterproof, collapsible material and having a first diameter; and a buoyancy ring sealingly connected to the first end of the tubular body, the buoyancy ring defining a through passage and having an outer diameter larger than the first diameter such that the buoyancy ring extends radially outwardly from the tubular body and is susceptible to a buoyancy force created at the exterior of the tubular body and an inner diameter smaller than the first diameter such that the buoyancy ring extends radially inwardly from the tubular body and is susceptible to a buoyancy force created at the interior of the tubular body.

2. The equipment protector according to claim 1 wherein the buoyancy ring is defined by a foam material.

3. The equipment protector according to claim 1 wherein the buoyancy ring is defined by an inflatable ring.

4. The equipment protector according to claim 3 wherein the inflatable ring has at least one inflation assembly associated therewith.

5. The equipment protector according to claim 4 wherein the at least one inflation assembly is configured to sense a liquid and inflate the inflation ring upon sensing of the liquid.

6. The equipment protector according to claim 5 wherein the inflation ring has at least first and second nipples configured to receive respective inflation assemblies and wherein the first nipple is positioned on an outer surface of the inflation ring and the second nipple is positioned on an inner surface of the inflation ring.

7. The equipment protector according to claim 1 wherein a bottom member manufactured from a waterproof material extends across and sealingly closes the second end of the tubular body.

8. The equipment protector according to claim 1 wherein the tubular body includes a sealable seam extending from the first end to the second end.

9. The equipment protector according to claim 8 wherein the sealable seam includes opposed portions of silicone tape.

10. The equipment protector according to claim 8 wherein the buoyancy ring is defined by an inflatable ring, the inflatable ring having closed ends which are aligned with the sealable seam.

11. The equipment protector according to claim 8 wherein the second end of the tubular body includes a sealing connector.

12. The equipment protector according to claim 11 wherein the sealing connector includes a connector ring about the second end of the tubular body.

13. The equipment protector according to claim 11 wherein the sealing connector includes a radial flange about the second end of the tubular body, the radial flange made of the same material and integral with the tubular body.

14. The equipment protector according to claim 1 further comprising at least one sensor/transmitter configured to send a signal indicating the presence of water to a valve and to thereby close the valve.

15. The equipment protector according to claim 1 further comprising at least one sensor/transmitter configured to provide an alarm indicative of the presence of water, the alarm including at least one of an audible alarm or a message communicated through wired or wireless communication.

16. An equipment protector comprising:

a tubular body extending from a first end to a second, the tubular body manufactured from a waterproof, collapsible material and having a first diameter; and a buoyancy ring, defined by an inflatable ring, sealingly connected to the first end of the tubular body;

wherein the tubular body includes a sealable seam extending from the first end to the second end and the inflatable ring has closed ends which are aligned with the sealable seam.

17. The equipment protector according to claim 16 wherein the sealable seam includes opposed portions of silicone tape.

18. The equipment protector according to claim 16 wherein the second end of the tubular body includes a sealing connector.

19. The equipment protector according to claim 18 wherein the sealing connector includes a connector ring about the second end of the tubular body.

20. The equipment protector according to claim 18 wherein the sealing connector includes a radial flange about the second end of the tubular body, the radial flange made of the same material and integral with the tubular body.

* * * * *